US006561618B1

(12) United States Patent
Simmons et al.

(10) Patent No.: US 6,561,618 B1
(45) Date of Patent: May 13, 2003

(54) SERVICE STATION FOR PRINTERS HAVING FIRING NOZZLES PERPENDICULAR TO DIRECTION OF CARRIAGE MOTION

(75) Inventors: Laura E Simmons, Corvallis, OR (US); Jonathan N Andrews, St McMinnville, OR (US); Stephen Vance Cooper, Amity, OR (US)

(73) Assignee: Agilent Technologies, Inc., Palo Alto, CA (US)

( * ) Notice: Subject to any disclaimer, the term of this patent is extended or adjusted under 35 U.S.C. 154(b) by 118 days.

(21) Appl. No.: 09/715,628

(22) Filed: Nov. 17, 2000

(51) Int. Cl.[7] ..... B41J 2/165
(52) U.S. Cl. ..... 347/32; 347/29
(58) Field of Search ..... 347/32, 22, 23, 347/14, 29, 30, 33, 35, 101

(56) References Cited

U.S. PATENT DOCUMENTS 4,825,231 A * 4/1989 Nozaki ..... 347/29
5,831,644 A * 11/1998 Kato ..... 347/22

FOREIGN PATENT DOCUMENTS

EP 0 676 291 A1 * 10/1995
EP 0686508 A 2/1996

* cited by examiner

*Primary Examiner*—Shih-wen Hsieh
(74) *Attorney, Agent, or Firm*—Pamela Lau Kee

(57) ABSTRACT

A thermal inkjet printer with firing nozzles perpendicular to the carriage motion has two motors: paper and carriage. These motors, alone or in concert, provide the power to the service station. The service station has separate wiping and pen cleaning functions. The wipers need to move across the pens in a direction that is perpendicular the carriage direction. Through the use of gears, the wipers can be made to clean the pens at the same time that the paper is being advanced and using the same motor source. For capping, the caps are moved into place as the pens come to rest. The motion of the pens themselves could easily push a lever that pushes the caps into place.

2 Claims, 12 Drawing Sheets

SERVICE STATION FOR PRINTERS HAVING FIRING NOZZLES PERPENDICULAR TO DIRECTION OF CARRIAGE MOTION

FIELD OF THE INVENTION

The invention is directed towards the field of thermal inkjet printers, particularly towards the pen maintenance thereof.

BACKGROUND

The service station in any thermal inkjet (TIJ) printer is a sub-assembly that is designed to enhance the life of TIJ pens, along with ensuring its health. This is accomplished in several ways. A rubber blade that is passed over the firing orifices, cleaning them of excess ink, periodically wipes the pens. All the pens are periodically fired into a "spittoon". This happens at several intervals, most notably when the "dot-count" reaches a certain value. This "dot-count" indicates that a set of the orifices within a pen have been fired a certain number of times, while other orifices within the same pen have not. The carriage is positioned over the spittoon and all the orifices are fired. This has the effect of ensuring the reservoirs maintain the appropriate level of pressure and fluidity and all the orifices do not clog or weep. The service station has a set of "caps" in it, one for each pen-head. During the times when the printer is not in use, the pens are positioned over the service station and the caps are moved to cover the firing heads. This protects the ink in the orifices from drying out during periods of non-use. The capping and wiping functions of the service station require motion in the service station with respect to the pens.

For TIJ printers having firing nozzles that are parallel to the direction of the carriage motion, the motion required for wiping and capping is parallel to the direction of the pen movement on the carriage. These TIJ printers, e.g. Lexmark, use the motion of the pens across the paper, which is driven by a dedicated motor, to mechanically move their service stations, as shown in FIG. 1. At the end of a print job, the pens move to the far right side of the printer where they hit a lever that moves the caps into place. When a new print job starts, the pens are moved to the extreme left of the printer. The start of this movement releases the capping switch and lowers the caps halfway, bringing the wipers into position. As the pens continue their motion, the orifices are wiped. After the final wiping motion is completed, the pen motion pulls the wipers into their 'rest' position, out of the way of normal operation.

For TIJ printers having firing nozzles that are perpendicular to the direction of the carriage motion, e.g. Hewlett-Packard 800 and 900 series, shown in FIG. 2, all three of the pen servicing operations require applied motion. That motion is achieved by using a motor to maneuver the entire service station assembly. For multiple colors, the wiping function performed by the service station has an additional complication. The wiping function is performed parallel to the direction of the firing nozzles. If one wiper blade serviced multiple colors, when the same wiper surface area is passed over different color firing nozzles, as would happen if the wiping function is perpendicular to the direction of the firing nozzles, the ink supplies will become contaminated. The firing nozzles for each color are perpendicular to the direction of pen motion. Additionally, perpendicular TIJ printers provide an isolated space for the spittoon and move that spittoon into position. The isolation keeps the excess ink away from the other contents of the printer. FIG. 3 illustrates a prior art service station for a perpendicular TIJ printer.

There are two basic "pen wipe" motions: wick and flicker. The squeegee blade may have any topology ranging from short and stiff to long and flexible. In the wick wipe, the squeegee blade is slowly dragged across the pen head, trying to pull some wet ink from each nozzle in an attempt to dissolve dried ink. In the flicker wipe, the blade is rapidly drawn across the orifices to wipe excess ink from the pen. The excess ink on the blade must then be removed. This is typically done by wiping the blade across a fixed plastic section found on the edge of the service station sub-assembly. Because of these different types of operations, speed control of the squeegee is required.

SUMMARY

The present invention is a thermal inkjet printer with firing nozzles that deposit ink perpendicular to the direction of carriage motion, having two motors: paper and carriage. These motors, alone or in concert, provide the power to the drive train of the service station. Within the service station, the drive train is coupled to pen cleaning, e.g. wiper blade, and pen capping functions. The wiper blade moves across the pens in a direction that is perpendicular to the carriage motion. Through the use of gears, the wipers can be made to clean the pens at the same time that the paper is being advanced, using the same motor source. For capping, the caps are moved into place as the pens come to rest. The motion of the pens themselves could easily push a lever that pushes the caps into place.

In one embodiment, the paper motor powers the service station. A carriage motor is connected to a carriage via a gear-set and a belt-drive. The carriage moves along a guided track, propelled by the belt drive. The carriage includes one or more pens each containing dedicated firing nozzles. A paper path motor provides power to a feed roller via a first gear transmission. A paper pick-up transmission lifts the paper into position where a paper pick-up roller pulls the paper into the printer. A second gear transmission provides power to the paper pick-up transmission. The paper motor is coupled either directly or indirectly to the drive transmission within the service station.

In one embodiment, the carriage motor powers the service station. The carriage motor is connected to a carriage via a gear-set and a belt-drive. The carriage moves along a guided track, propelled by the belt drive. The carriage includes one or more pens each containing dedicated firing nozzles. A paper path motor provides power to a feed roller via a first gear transmission. A paper pick-up transmission lifts the paper into position where a paper pick-up roller pulls the paper into the printer. A second gear transmission provides power to the paper pick-up transmission. The axial motion of the carriage is transformed into perpendicular-to-axial motion for the wipers through a number of mechanical means, e.g. levers, gears, springs, or a combination thereof. The carriage motion may be used to raise and lower the pen caps also through a series of levers, gears, springs, or a combination thereof.

DETAILED DESCRIPTION OF THE INVENTION

Figure 1:
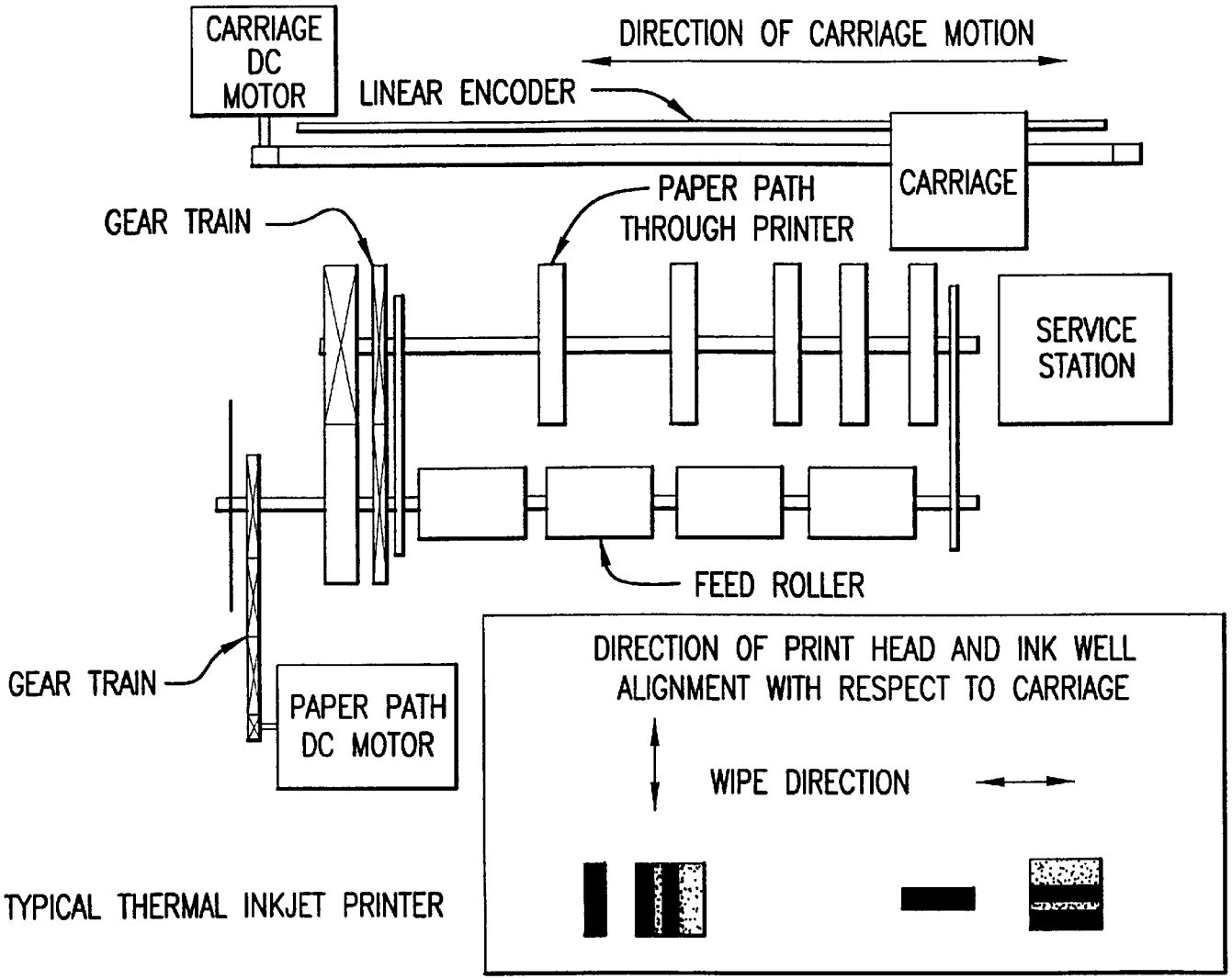
FIG. 1 (PRIOR ART)
FIG. 1 illustrates a thermal inkjet printer having service station motion perpendicular to the direction of pen movement (prior art).
Figure 2:
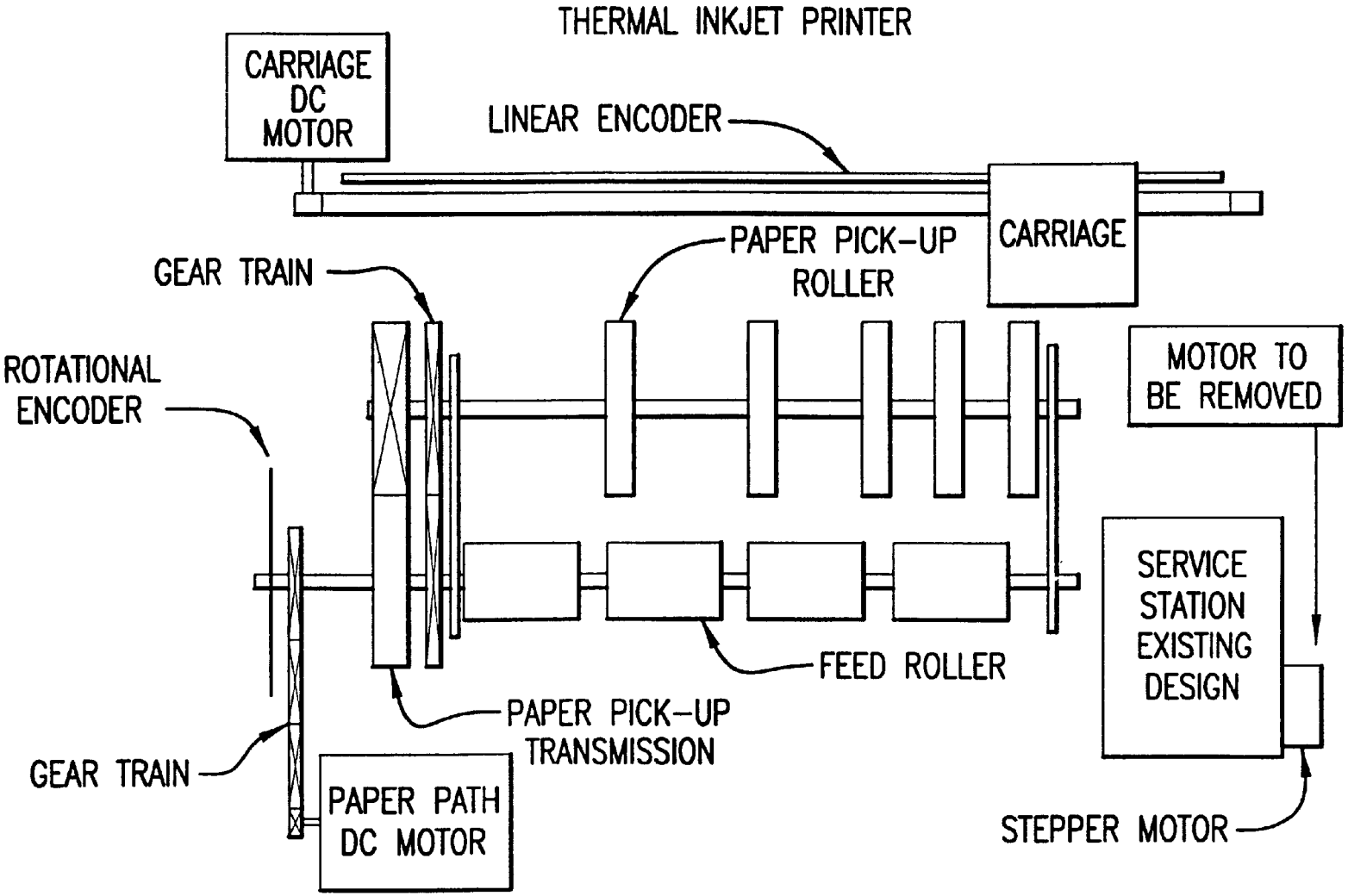
FIG.2 (PRIOR ART)
FIG. 2 illustrates a thermal inkjet printer having service station motion parallel to the direction of pen movement (prior art).
Figure 3:
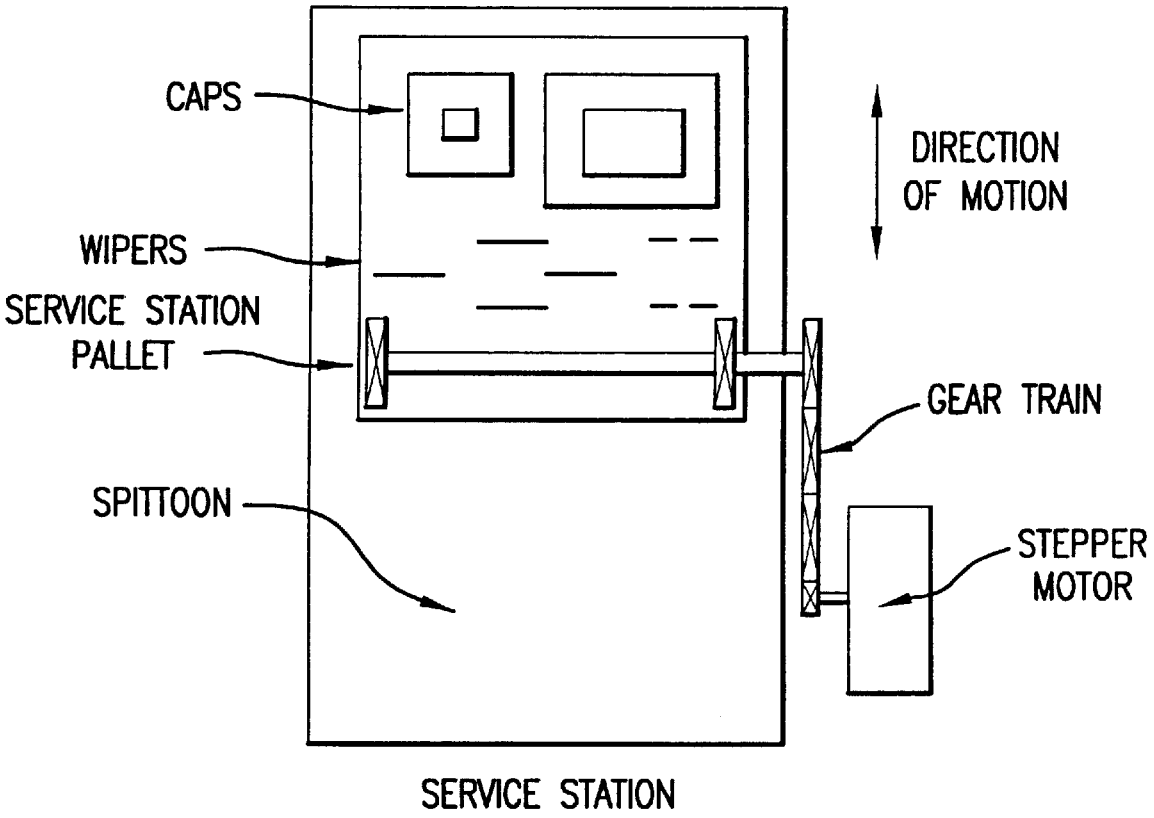
FIG.3 (PRIOR ART)
FIG. 3 illustrates a prior art service station for the thermal inkjet printer shown in FIG. 2.
Figure 4:
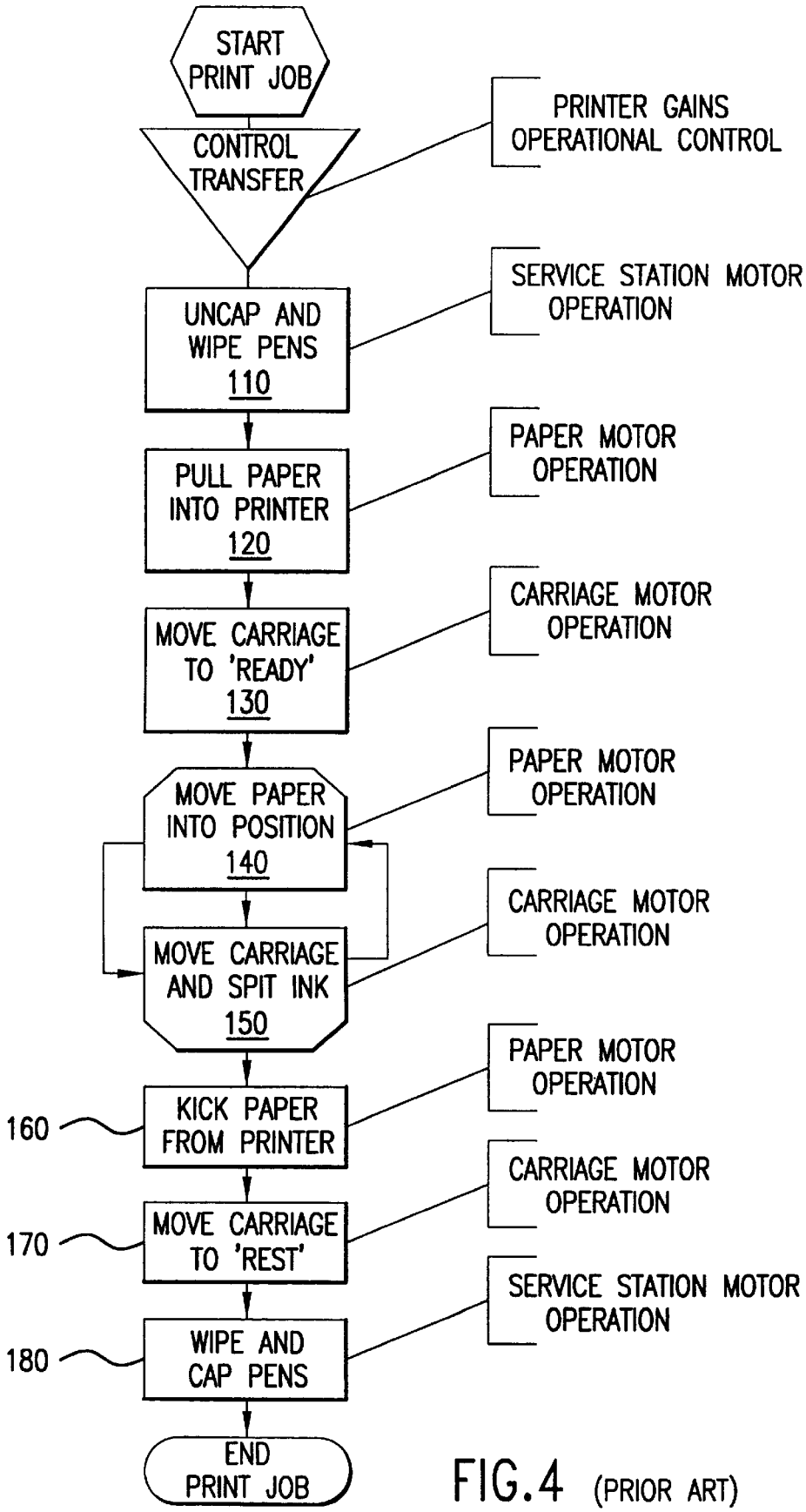
FIG.4 (PRIOR ART)
FIG. 4 illustrates a process flowchart corresponding to the prior-art thermal inkjet printer shown in FIG. 2.

FIG. 4 illustrates a process flowchart corresponding to the prior art functionality of the printer. In step 100, the printer gains operational control of the job. In step 110, the pens are uncapped and wiped. In step 120, paper is pulled into the printer. In step 130, the carriage is initialized. In step 140, the paper is advanced. In step 150, the carriage is moved and ink is spit onto the paper. Steps 140 and 150 are repeated until the print job is complete. A new piece of paper is loaded without servicing the pens. The rest of the flow chart corresponds to when the last page is printed. In step 160, the paper is "kicked" from the printer, coming to rest in the out tray. In step 170, the carriage is moved to the "rest" position. In step 180, pens are wiped and capped.

Figure 5:
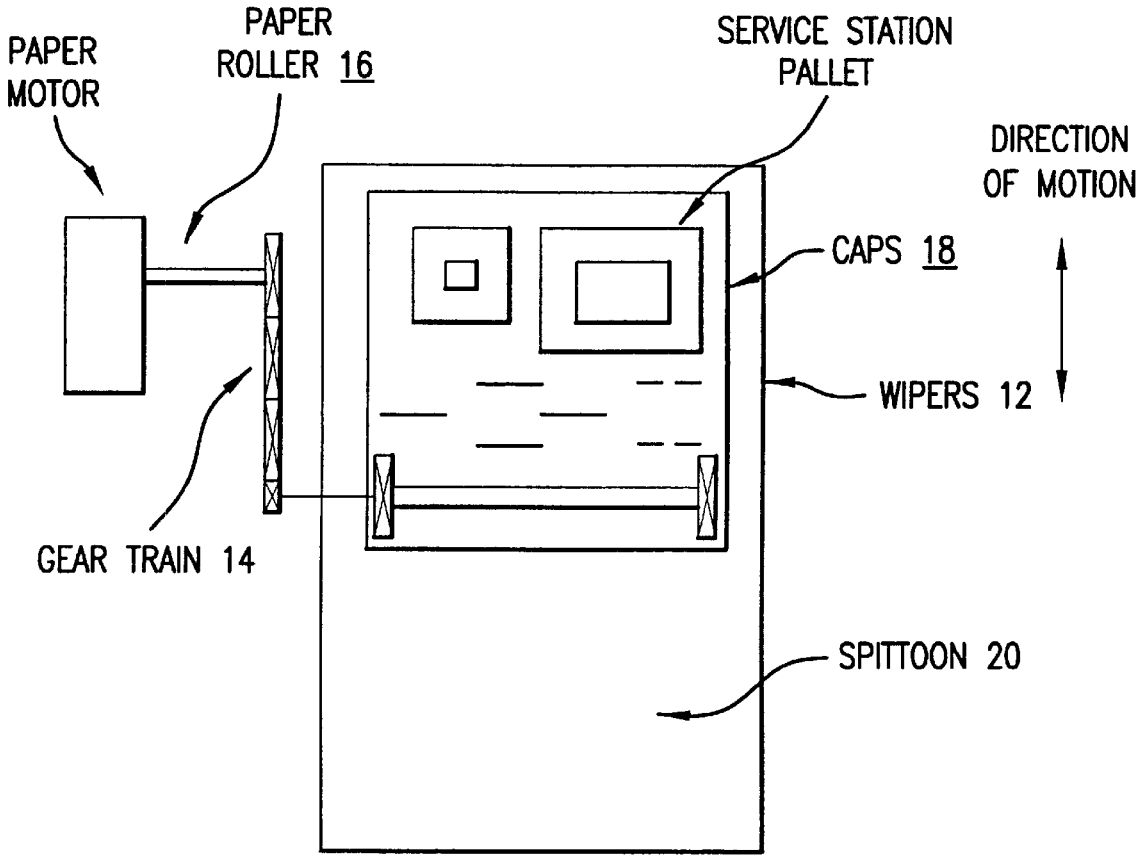
FIG. 5 illustrates a service station of the present invention.

FIG. 5 illustrates a service station lo of the present invention. Piece 1 would be the wipers 12. The wipers 12 must move across the pens in a direction that is parallel to the direction that the paper moves to preserve the ink supply. Through the use of gears 14 connected to the paper rollers 16, the wipers 12 can be made to clean the pens at the same time that the paper is being advanced, using the same motor source. Piece 2 is the service station capping function 18. This function requires moving the caps into place as the pens come to rest. The motion of the pens themselves could easily push a lever that pushes the caps into place. A spittoon 20 collects the residual ink.

One method for providing the "wipe" function is to mold a reinforced, ethylene, propylene diene modified co-polymer (EPDM) continuous belt, similar to a conveyer belt. The squeegee elements would be molded on to the outer surface of the belt. This "squeegee belt" is mounted on two rollers that contact the surface of the belt. One roller is an idler and the other is affixed to the drive roller. This assembly is placed on one side of the paper path. When a wipe is needed, the pen carriage moves the pens over the "squeegee belt", the drive roller turns and the squeegee is moved across the orifice plate. Mounting the "squeegee belt" in this orientation provides the correct squeegee motion for pens that move perpendicular to the carriage axis. In one embodiment, the squeegee belt runs continuously, however a transmission may be provided to engage the "squeegee belt" upon demand (the pen carriage can trip the transmission when it is in position for a wipe. In this embodiment, the wipe cannot be done while paper is loaded in the drive roller.

At the end of the print job, the pens come to rest at the right side of the carriage against a lever. This pushes the cap against the pens, sealing them from the atmosphere. At the start of a new print job, the pens move to the left of the printer where they wait for the paper to move into position. As they come to rest, they push a toggle that translates the horizontal motion of the carriage to a vertical wiping motion. After the wipe pass is complete, and the pen moves to print, the wiper is returned to its at-rest position, along with the toggle.

The axial motion of the carriage can be transformed into perpendicular-to-axial motion for the wipers through a number of mechanical means, e.g. levers, gears, springs, or a combination thereof. The carriage motion may be used to raise and lower the pen caps also through a series of levers, gears, springs, or a combination thereof.

Figure 6:
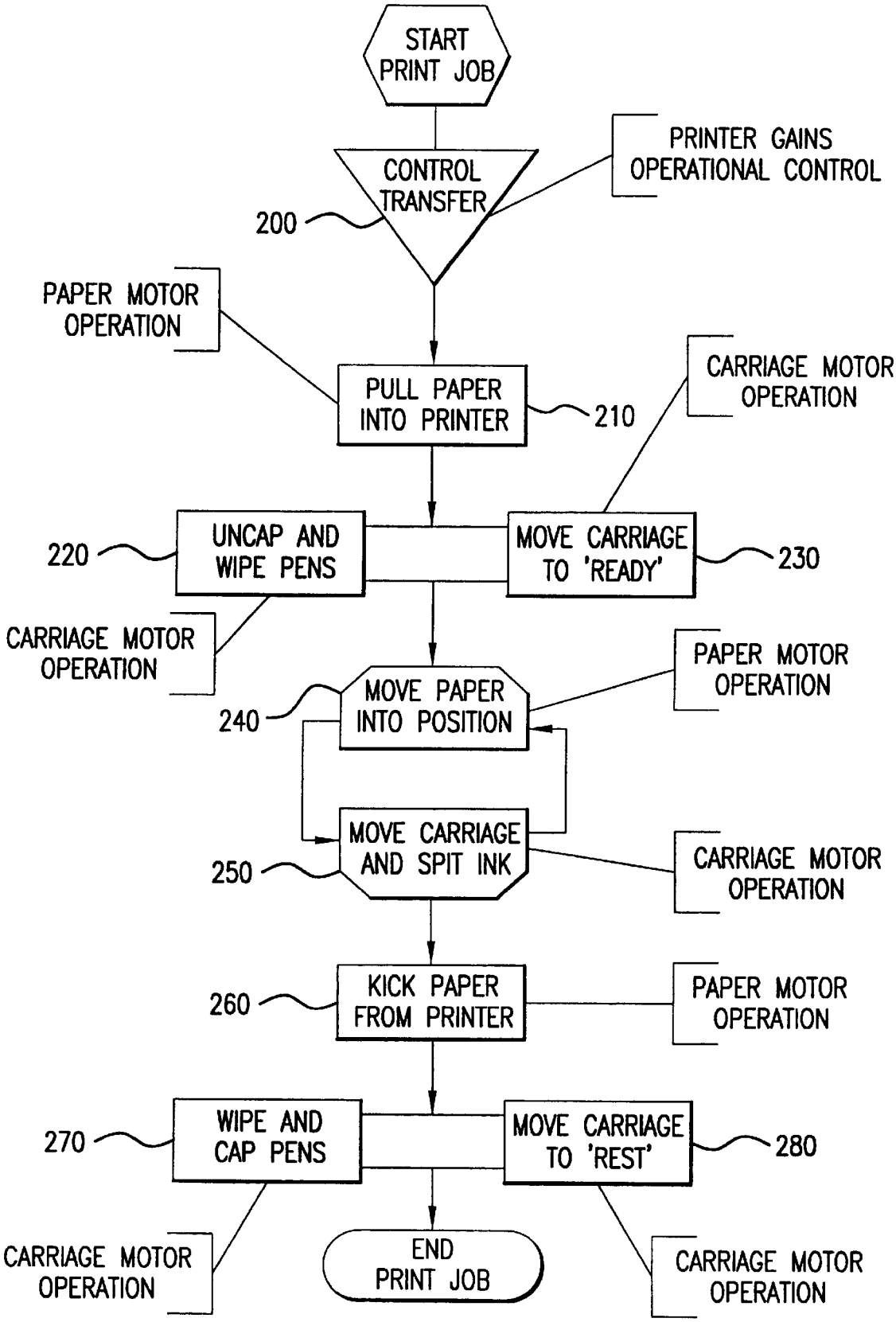
FIG. 6 illustrates a process flowchart corresponding to the thermal inkjet printer having a service station powered by the carriage motor.

FIG. 6 illustrates a process flowchart corresponding to a thermal inkjet printer having a carriage motor that transfers power to the service station. In step 200, the printer gains operational control of the job. In step 210, paper is pulled into the printer. In step 220, the pens are uncapped and wiped. In step 230, the carriage is initialized. Steps 220 and 230 may occur simultaneously. In step 240, the paper is advance. In step 250, the carriage is moved and ink is spit onto the paper. Steps 240 and 250 are repeated until the job is printed. In step 260, the paper is "kicked" from the printer. In step 270, the pens are wiped and capped. In step 280, the carriage is moved into the "rest" position. Steps 270 and 280 may occur simultaneously.

Similar to the last embodiment, the wiping function can occur. The capping function may occur as follows. As the pens come to rest, they hit a transmission that causes the caps to be lifted as the paper is driven out.

Figure 7:
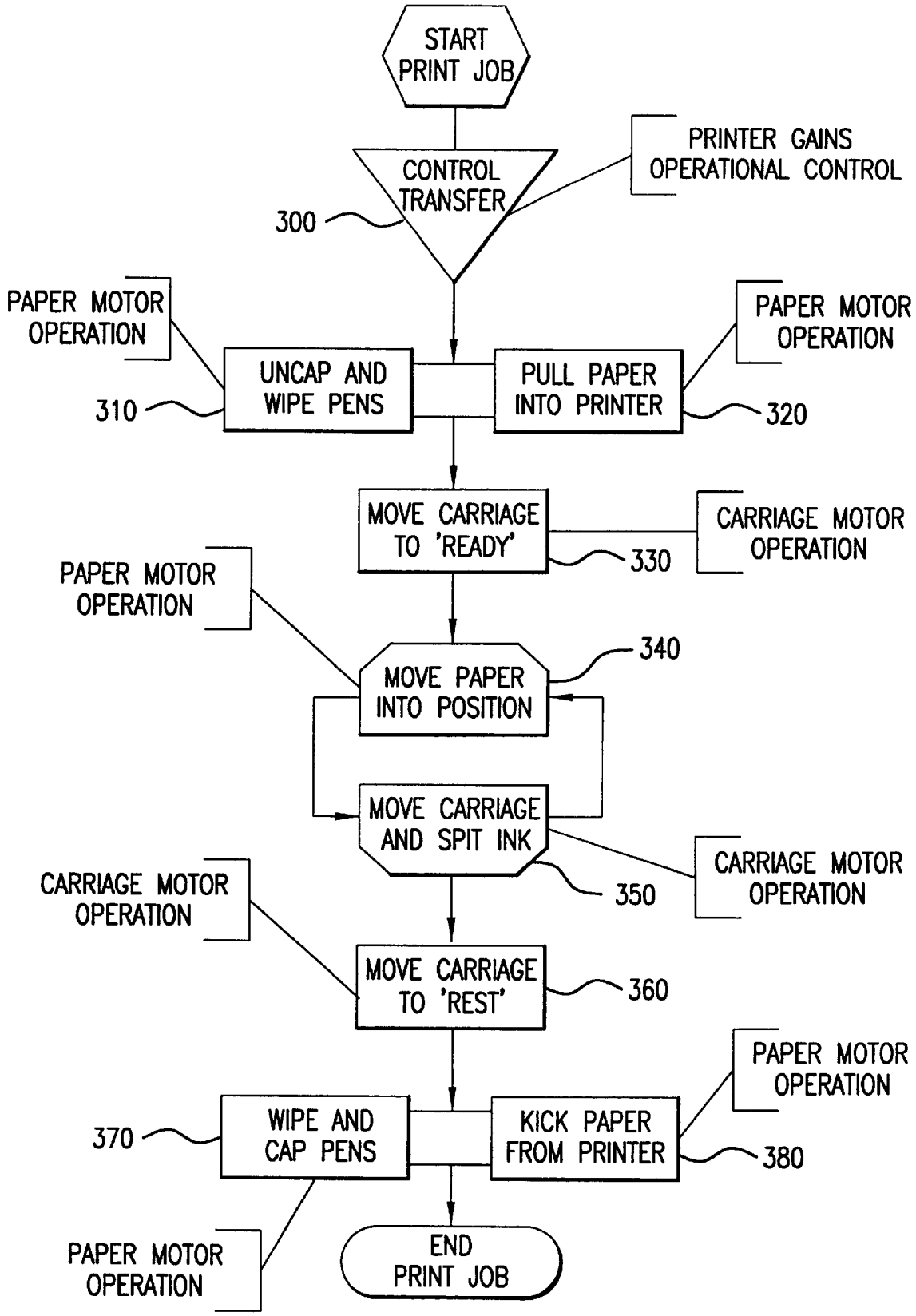
FIG. 7 illustrates a process flowchart corresponding to the thermal inkjet printer having a service station powered by the paper motor.

FIG. 7 illustrates a process flowchart corresponding to a thermal inkjet printer having a paper motor coupled to the service station. In step 300, the printer gains operational control of the job. In step 310, the pens are uncapped and wiped. In step 320, paper is pulled into the printer. Steps 310 and 320 may occur simultaneously. In step 330, the carriage is initialized. In step 340, the paper is advance. In step 350, the carriage is moved and ink is spit onto the paper. Steps 340 and 350 are repeated until the job is printed. In step 360, the carriage is moved into the "rest" position. In step 370, the pens are wiped and capped. In step 380, the paper is "kicked" from the printer. Steps 370 and 380 may occur simultaneously.

Figure 8:
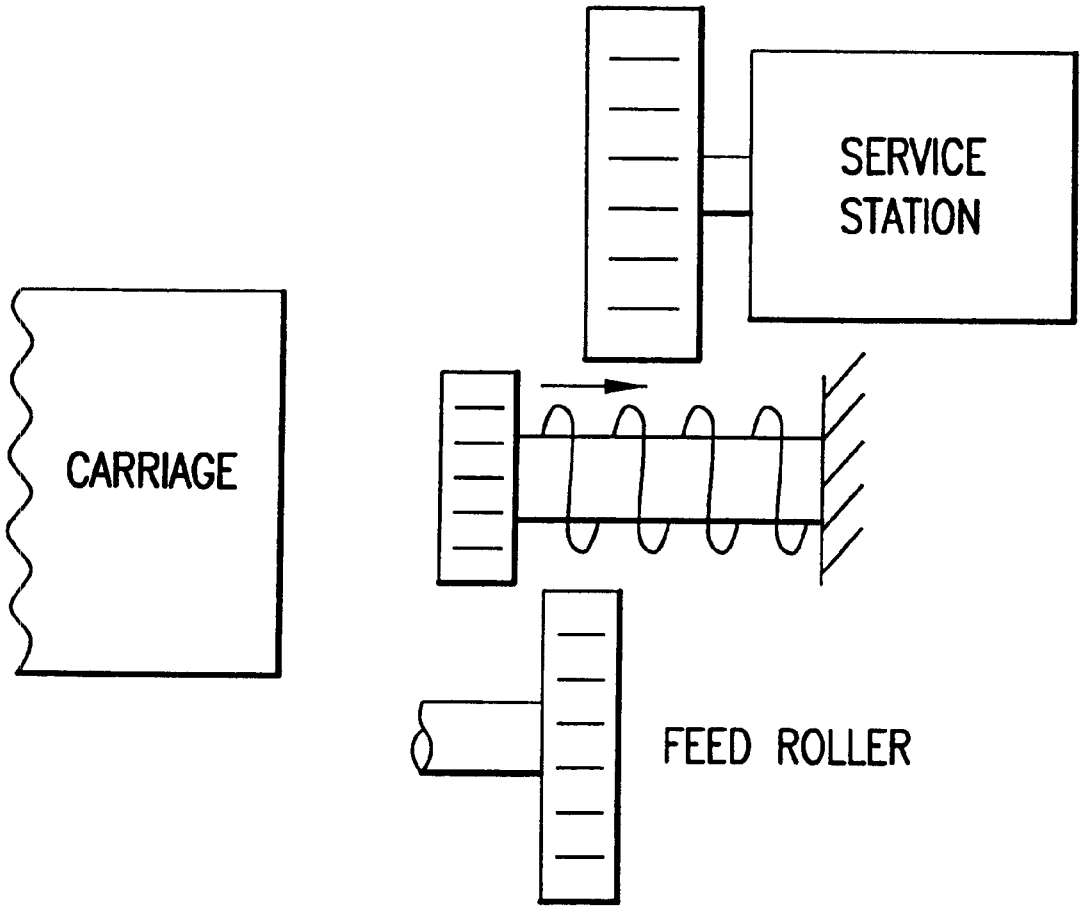
FIG. 8 illustrates an embodiment for the transmission assembly.

FIG. 8 illustrates one embodiment for the transmission assembly that transfers power from the paper motor to the service station. The carriage motor is used as a clutch to engage the gears while movement of the service station comes from the paper motor. The carriage pushes an idler into drive and loads the gears. The gears transfer power from the feed roller to the service station. The paper motor (not shown) powers the feed roller.

Figure 9:
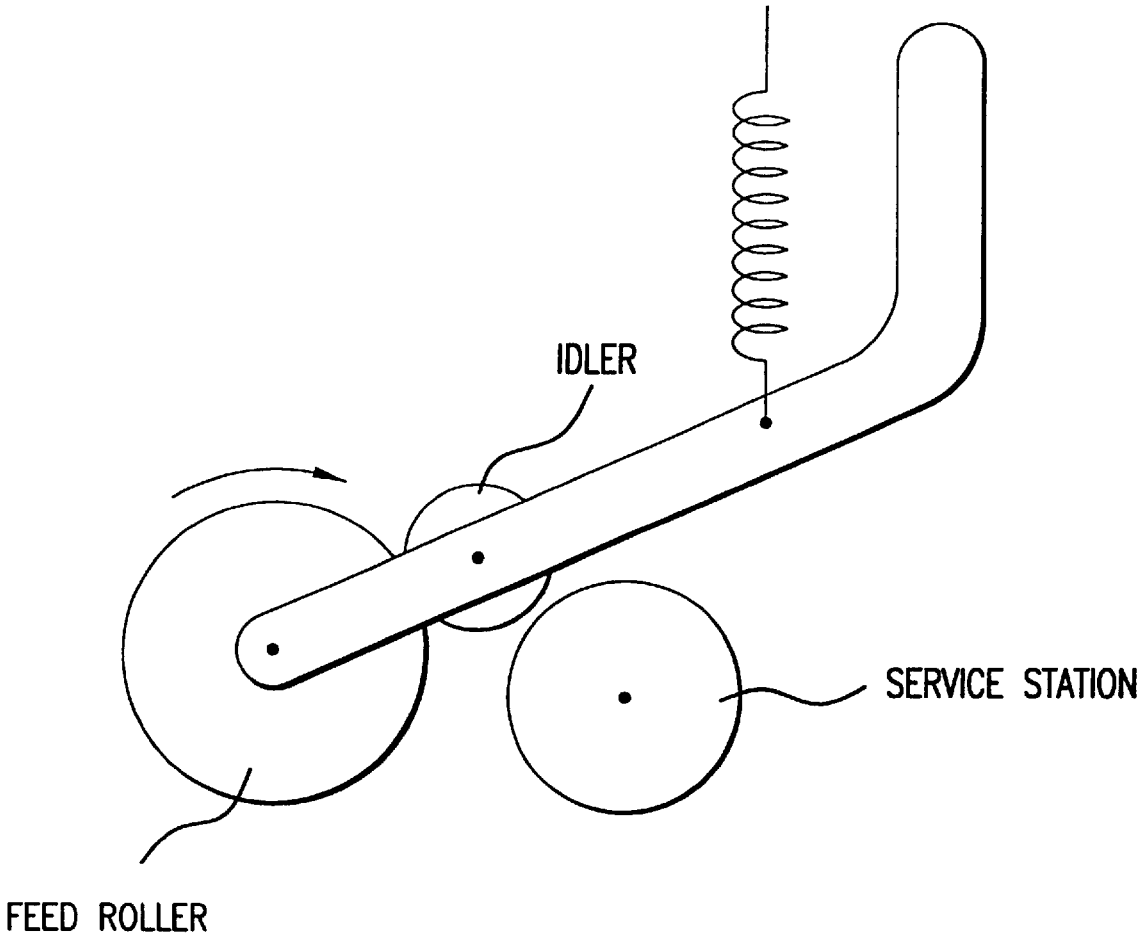
FIG. 9 illustrates an alternate embodiment for the transmission assembly.

FIG. 9 illustrates an alternate embodiment for the transmission assembly. The drive gear, idler gear, and link are mounted to the drive shaft. When the carriage parks over the service station, the carriage pivots around the carriage slide shaft and tips back toward the service station. This rotation is caused by features in the top sheet metal carriage guide. This "tipping back" engages the idle gear by pushing down on the link when the carriage is over the service station.

Figure 10:
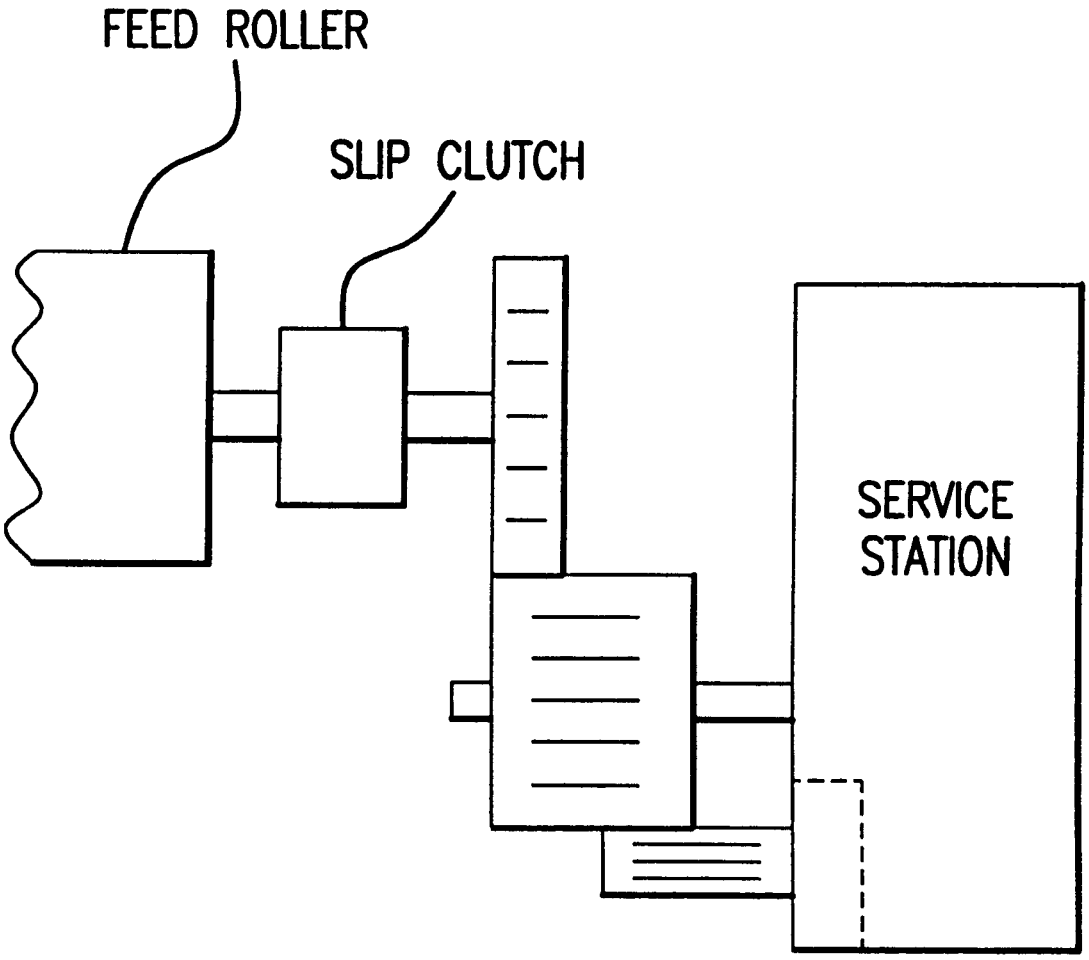
FIG. 10 illustrates another embodiment for the transmission assembly.

FIG. 10 illustrates another embodiment for the transmission assembly. The feed roller runs a bidirectional slip clutch that is tied to the service station gear transmission. When the feed roller is powered forward (feeding paper), the service station is driven in the "uncap" direction until it hits the "end of stop". At this point, the clutch slips, many pages are printed and the pen spits when needed. Upon print completion, the pen is moved into position over the service station and the feed roller motion is reversed. The service station is driven into the "pen cap" position. When the service station reaches the end of travel, pens are capped as the clutch slips. The DC motor may be driven beyond the required distance to ensure that the service station has reached the end of travel.

Figure 11:
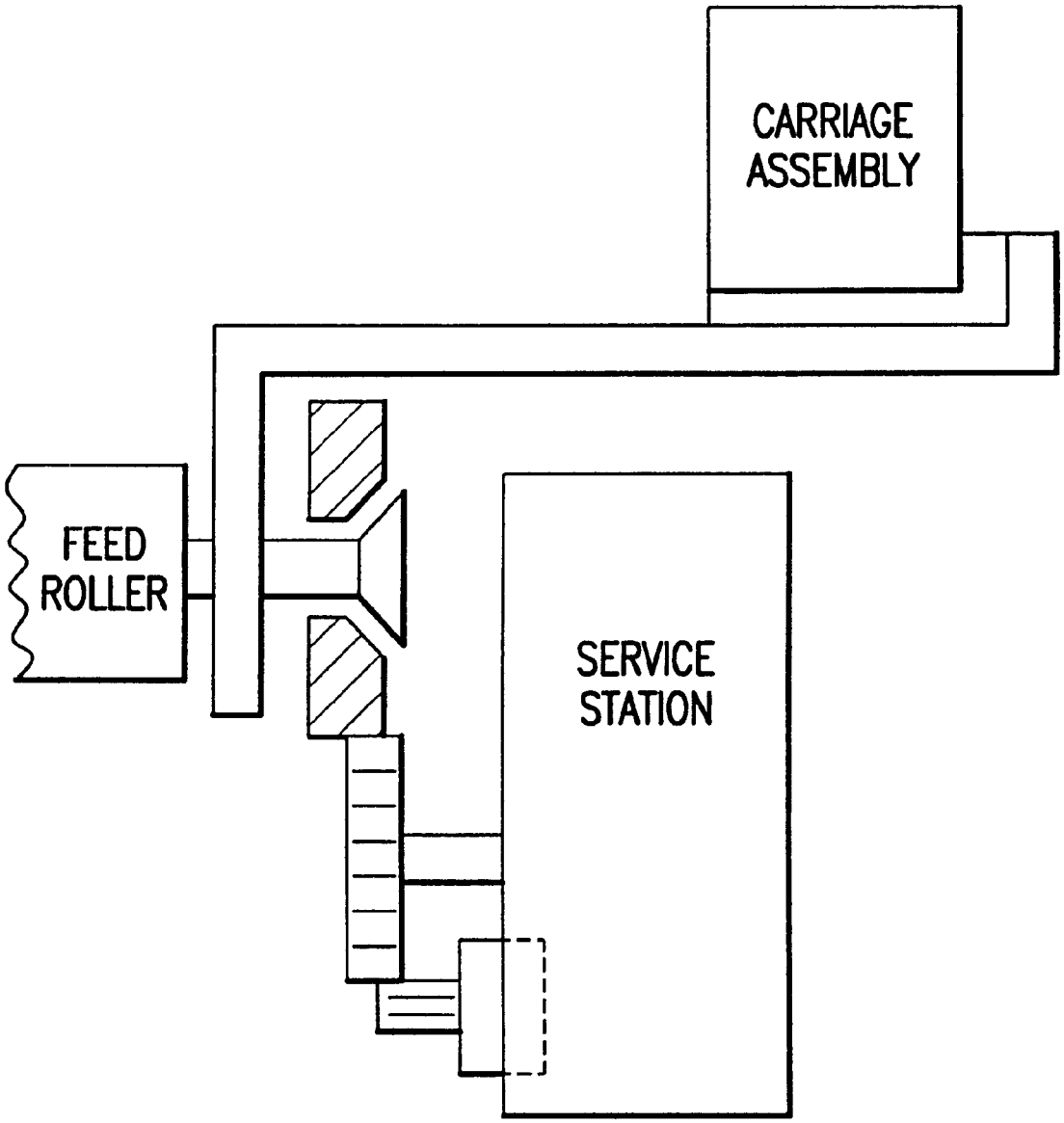
FIG. 11 illustrates another embodiment for the transmission assembly.

FIG. 11 illustrates another embodiment for the transmission assembly. In this embodiment, the carriage motor is coupled to the service station. During printing, the drive gear does not rotate because it is held by friction and inertia of the service station drive train. It rides on the feed roller shaft (slips). Its teeth are meshed with the service station drive transmission gear. When the carriage towards the service station, it eventually contacts a pressure arm. This arm contacts a rubber ring on the back of the drive gear forcing it against the rubber piece. When sufficient force is applied, friction between the rubber and the drive gear causes the drive gear to turn, which in turn powers the service station drive train. The rubber needs to grip the shaft tightly. The angles on the rubber and drive gear can be such that when the gear is pulled tight, it helps the rubber bite into the shaft.

Figure 12:
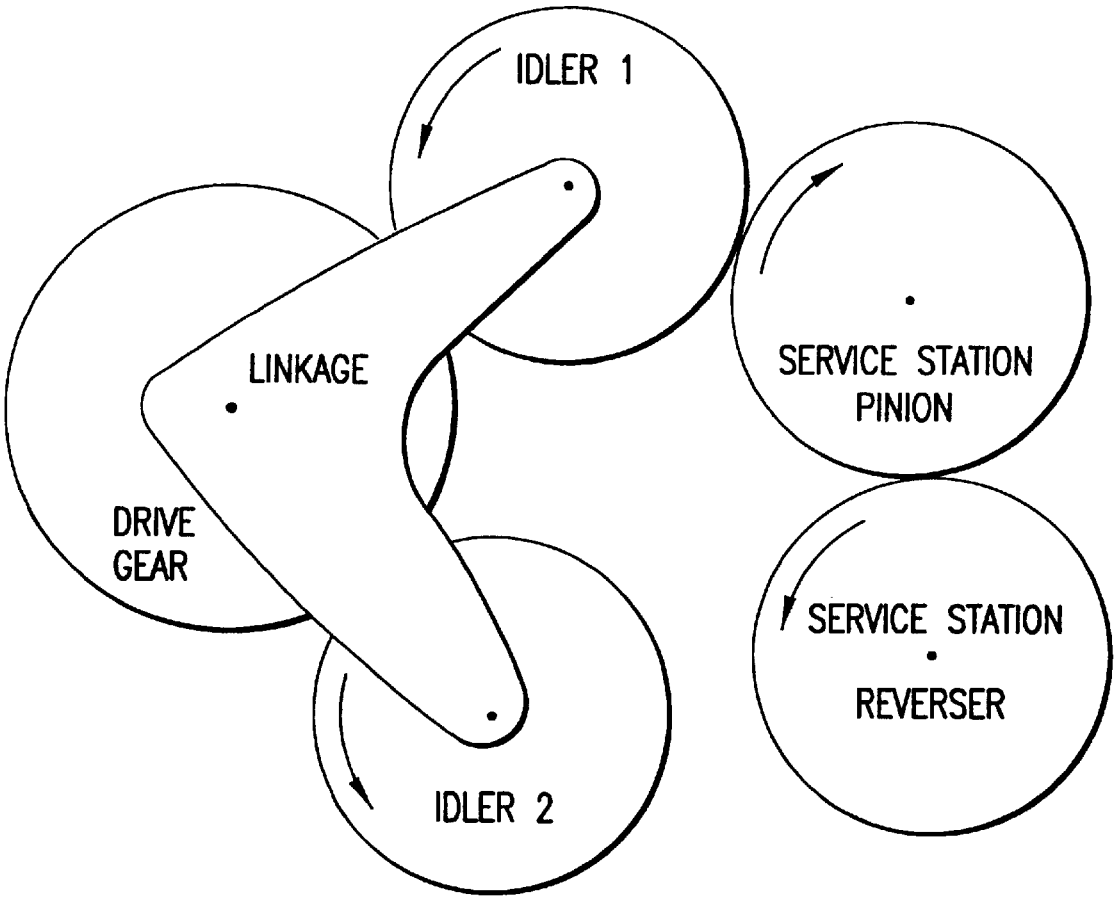
FIG. 12 illustrates another embodiment for the transmission assembly.

FIG. 12 illustrates another embodiment for the transmission assembly. The paper motor is coupled to the service station power by reversing the paper feed roller. When the paper feed roller is powered forward, a one way clutch prevents power from being transferred to the service station drive train. When the motor is reversed, the one way clutch grabs, engaging the service station drive train. The service station pinion drives the rack moving the service station out of pen park (pen cap). The service station continues until it reaches its end of travel at which point the software detects motor stall and the service station is in the spit position. Just before "end of travel" a feature on the shuttle activates (shifts) the toggle mechanism to reverse the shuttle drive direction. The next time the feed roller is reversed, the service station pinion drives the shuttle's rack into the pen cap position. "End of travel" is again reached, the motor stalls, the toggle shifts and the pen is capped.

While the above illustrations depict embodiment where either the carriage or the paper motor transfers power to the service station, it will be apparent to those with skill in the art that the carriage and paper motors, in concert, may be used to transfer power to the service station.

We claim:

1. A thermal inkjet printer comprising:

a carriage assembly including a carriage motor and pens;

a paper transport assembly including a paper motor and feed roller that is mechanically coupled to the paper motor;

a service station having a drive gear coupled to a wiper blade and a pen capping means for capping and uncapping the pens; and a transmission assembly, coupled to the carriage and paper transport assemblies, coupled to the drive gear, being operative to transfer power from the paper transport assembly to the drive gear, including a bi-directional slip clutch connected to the feed roller, coupled to the drive gear;

when the feed roller operates in a forward direction, the pen capping means uncaps the pens;

when the feed roller operates in a reverse direction, the pen capping means caps the pens.

2. A thermal inkjet printer comprising:

a carriage assembly including a carriage motor and pens;

a paper transport assembly including a paper motor and feed roller that is mechanically coupled to the paper motor, the feed roller positioned on a drive shaft;

a service station having a drive gear coupled to a wiper blade and a pen capping means for capping and uncapping the pens, the drive gear positioned on the drive shaft; and a transmission assembly, coupled to the carriage and paper transport assemblies, coupled to the drive gear, being operative to transfer power from the paper transport assembly to the drive gear, including a pressure arm interposing the feed roller and drive gear;

when the pressure arm is engaged by the feed roller, the drive gear is engaged.

* * * * *